US006880671B2

(12) United States Patent
Raby

(10) Patent No.: US 6,880,671 B2
(45) Date of Patent: Apr. 19, 2005

(54) SAVE ME! SLING

(76) Inventor: Charmaine Raby, 100 Windtree Valley, Parkton, MD (US) 21120

( * ) Notice: Subject to any disclaimer, the term of this patent is extended or adjusted under 35 U.S.C. 154(b) by 0 days.

(21) Appl. No.: 10/633,374

(22) Filed: Aug. 2, 2003

(65) Prior Publication Data

US 2005/0023081 A1 Feb. 3, 2005

Related U.S. Application Data

(60) Provisional application No. 60/400,625, filed on Aug. 1, 2002.

(51) Int. Cl.[7] ..... A62B 1/00
(52) U.S. Cl. ..... 182/7; 182/18
(58) Field of Search ..... 182/3–7, 231–240, 182/70, 73, 71, 18

(56) References Cited

U.S. PATENT DOCUMENTS 219,511 A * 9/1879 Petterson ..... 182/7
285,564 A * 9/1883 Brooks ..... 182/72
696,931 A * 4/1902 Boettcher ..... 182/236
3,871,480 A * 3/1975 Sauri ..... 182/100
4,842,219 A * 6/1989 Jakubowski et al. ..... 244/31
6,029,771 A * 2/2000 Keown ..... 182/7
6,672,428 B1 * 1/2004 Gelman ..... 182/233

* cited by examiner

*Primary Examiner*—Alvin Chin-Shue
(74) *Attorney, Agent, or Firm*—Law Offices of Royal W. Craig

(57) ABSTRACT

A fire escape device that enables parents to lower their children (as well as pets and possessions) to the safety of the ground from elevated windows or terraces of tall structures. The load-lowering device is a hard-shell vessel cradled in a fire-resistant sling that is attached to a load-carrying harness. A variable-length tether is attached to the harness for lowering the assembly. A descent control fixture, a cleat only, is affixed beneath each window and to each terrace rail in the dwelling, and this gives the occupants a plurality of stations at which to deploy the fire escape device in case of emergency. After loading the device with children, pets and/or possessions, the device allows its contents to be secured lowered in a manually-controlled descent to the ground.

17 Claims, 7 Drawing Sheets

SAVE ME! SLING

CROSS-REFERENCE TO RELATED APPLICATIONS

The present application derives priority from U.S. provisional application No. 60/400,625, filed Aug. 1, 2002.

BACKGROUND OF THE INVENTION

1. Field of the Invention

The present invention relates to fire safety and, more particularly, to a tethered fire escape vessel for lowering children, pets and/or possessions to the ground from a window or terrace.

2. Description of the Background

There are a variety of fire escape devices for multi-level buildings and dwellings, and these range from complex elevators to folding ladders, and simple harnesses for lowering people to the ground. Many of the latter devices utilize a harness attached to a rope that is wound about a pulley mechanism inside the dwelling. The rate of descent of the passenger may be controlled by hand out of a window or off a terrace.

Examples of such devices may be seen in the following U.S. Pat. Nos. 1,128,025 (Mass); 1,351,734 (Barrington); 2,432,741 (Frankel); and 4,550,801 (Forrest).

Most of the devices described in the above patents are quite cumbersome and are installed at a single window or terrace for dedicated use. Such devices are not practical in an emergency situation where access to that particular door or window may be blocked. It is more desirable that a fire escape device be less cumbersome so that it is not considered an eyesore, and portable for use at any window or other evacuation point. Moreover, although the prevalent use of this sort of device is in lowering children and pets to the ground, the existing prior art cannot accommodate multiple occupants in a balanced vessel, and it provides little or no protection against heat and flames. It would be far safer if all the passengers could be comfortably balanced and fully protected when they are being lowered so that their descent is not hindered. In addition, there is a need for a failsafe descent control provision that will prevent ground impact if the parent loses control of the rope.

Consequently, it is desirable to provide an improved fire escape device that addresses the problems faced by the above prior art devices. The device should be reasonably portable so that it may be conveniently stored, and usable at any of a variety of possible escape routes such as windows or terraces. Above all, the device should ensure that a plurality of children and or pets can be safely, securely and comfortably balanced during a controlled-descent to the ground.

SUMMARY OF THE INVENTION

It is, therefore, an object of the present invention to provide a fire escape device that is portable and can be used at any of a variety of predetermined windows or other evacuation points. It is another object to provide a fire escape device that safely, securely and comfortably balances multiple children, pets and other articles throughout a controlled-descent to the ground.

It is another object to provide a fire escape vessel that offers maximum strength, security and protection against heat and flames, as well as a failsafe descent feature to avoid impact with the ground if the user loses control.

According to the present invention, the above-described and other objects are accomplished by providing a tethered fire escape vessel for lowering children, pets and/or possessions to the ground from a window or terrace. Generally, the device comprises a hard-shell vessel cradled in a fire-resistant sling that is attached to a load-carrying harness. A variable-length tether is attached to the harness for lowering the assembly. A descent control fixture such as a simple cleat is affixed beneath each window and to each terrace rail in the dwelling, and this gives the occupants a plurality of stations at which to deploy the fire escape device in case of emergency. After loading the device with children, pets and/or possessions, the device allows its contents to be securely lowered in a manually-controlled descent to the ground.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENTS

Figure 1:
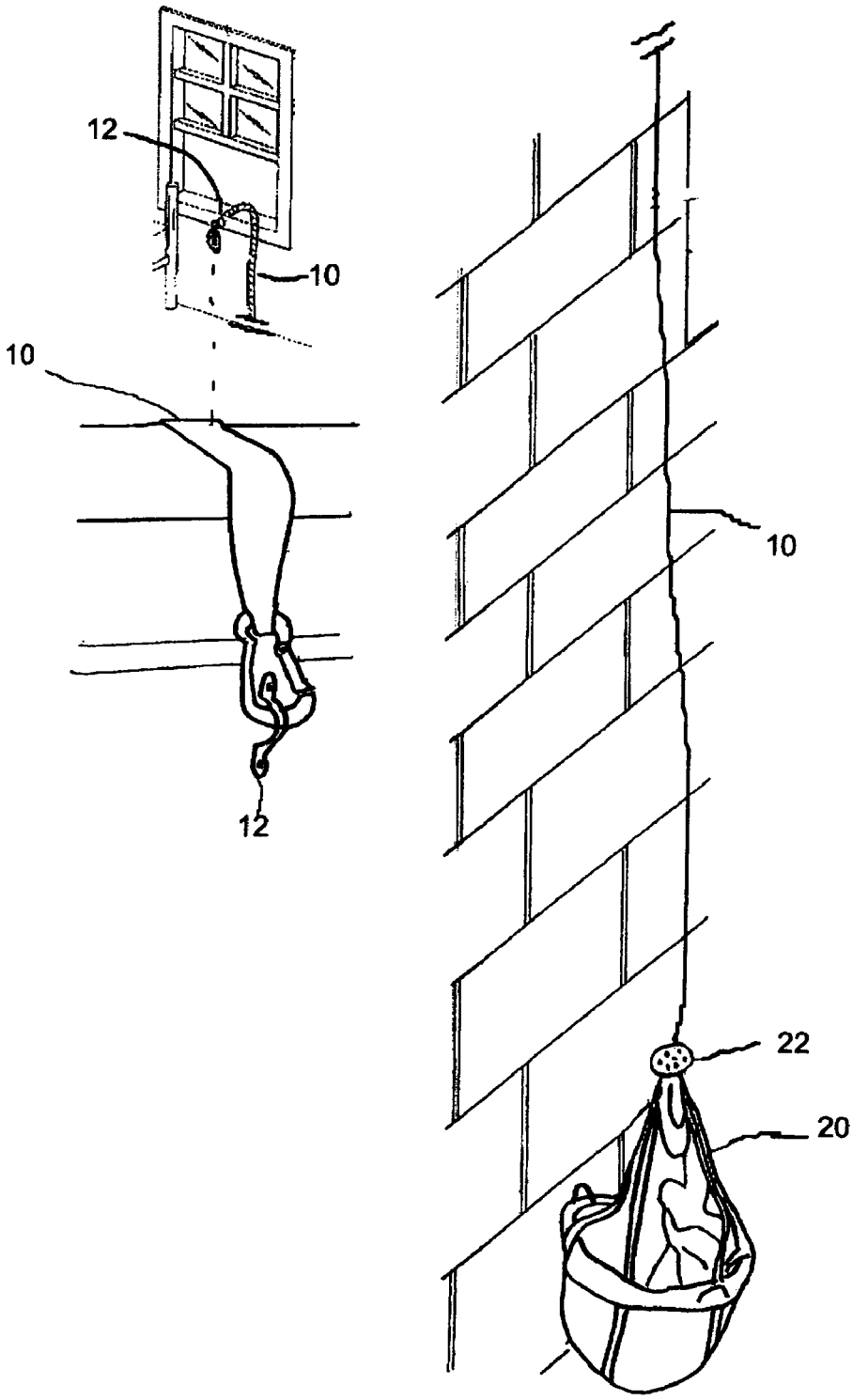
FIG. 1 is a perspective drawing of a tethered fire escape for lowering children, pets and/or possessions to the ground from an upper-level window or terrace according to one embodiment of the present invention.

FIG. 1 is a perspective drawing of a tethered fire escape for lowering children, pets and/or possessions to the ground from an upper-level window or terrace. The fire escape generally comprises a fully-enclosed and fire-insulated hard-shell vessel 20, variable tether 10, and a descent control fixture 12 attached inside a window or to a terrace. An intermittent strobe 22 is attached to the variable tether 10 to signal the attention of emergency personnel.

The descent control fixture 12 is preferably a commercially-available cleat, or rope clutch anchored by 2×3" wood screws inside and beneath the window sill or terrace rail such that a user can attach the variable tether 10 via a spring clamp directly to descent control fixture 12 in order to limit downward descent. Preferably, a variety of such descent control fixtures 12 are provided in kit form so that the user can attach them at key escape routes throughout the dwelling.

Figure 2:
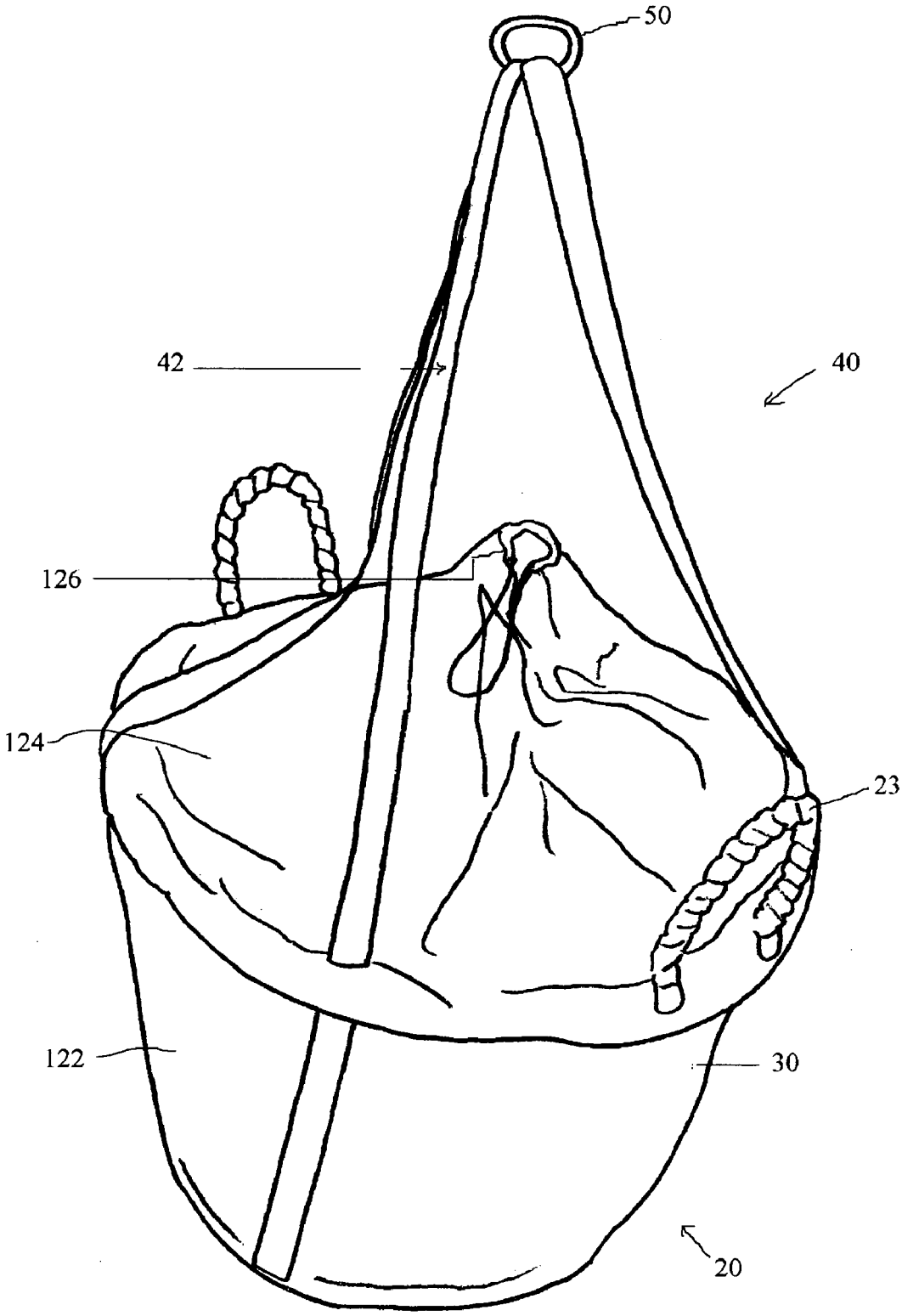
FIG. 2 is a close-up view of the vessel 20 used in the tethered fire escape of FIG. 1.

FIG. 2 is a close-up view of the vessel 20. Vessel 20 further comprises a plastic bucket 24 (obscured) preferably of approximately 30 gallon size with opposing rim-mounted carrying handles 23. Suitable blow-molded buckets are readily commercially available. Bucket 24 is encased in a fire-resistant sling 30. Sling 30 is sewn from a pattern using a fire-resistant fabric such as Dupont's NOMEX® III or other fabric that complies with the Minimum Thermal Protective Performance Ratings established by NFPA. The sling 30 completely covers bucket 24 and the illustrated embodiment includes a bottom panel 120 sewn to a side panel 122, and a top panel 124 sewn to the side panel 122 for covering the vessel 20. In the illustrated embodiment the top panel 124 includes an outer seam 126 for insertion of a draw-string with closure to allow the user to close the sling 30 over its occupants/contents. Alternately, the outer seam 126 and draw-string may be replaced with a hemmed zipper across the top. Apertures are provided in the sling 30 as shown to allow the handles 23 of bucket 24 to protrude through. The panels of sling 30 conform to the shape of the bucket 24 and fully enclose and protect it.

The sling 30 and bucket 24 are supported by a harness 40 which is formed from a single length of strap, preferably braided safety nylon designed for climbing. Such strap is readily commercially available, it is flexible, easy handling, and doesn't bunch when in use. It is noteworthy that the harness 40 is a single length of strap because this adds greatly to the strength of the device and also achieves economy of manufacture. This can be accomplished with a length of woven nylon strap of about 15 feet in length that is secured at one end to a spring link connector 50 disposed above the sling 30, the other end of the strap being run down and under the sling 30/bucket 24, up and through the spring link connector 50, and down again and under the sling 30/bucket 24 and up and to the spring link connector 50 where the other end is secured. This results in the harness 40 having a cradle configuration in which the sling 30/bucket 24 are doubly-supported by two orthogonal loops, or four evenly-spaced lengths 42 of the harness 40.

Figure 3:
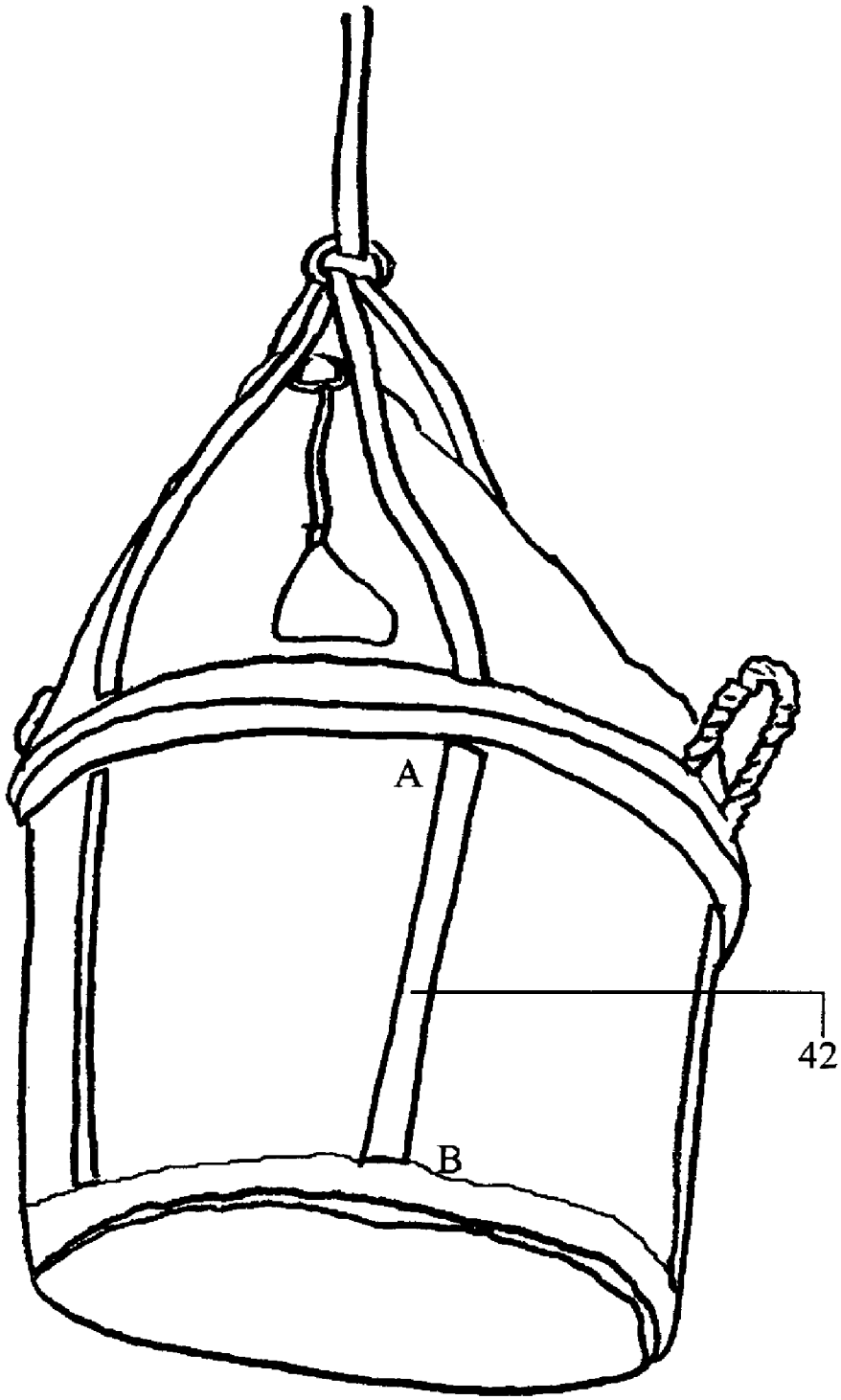
FIG. 3 is a side perspective view of the vessel 20 which illustrates the preferred harness 40 configuration.

FIG. 3 is a side perspective view of the vessel 20 which illustrates the above-described harness 40 configuration. Preferably, each of the four evenly-spaced lengths 42 of the harness 40 penetrate both the sling 30 and bucket 24 at two insertion points A and B, resulting in a total of eight insertion points. Specifically, at insertion point A the length 42 of the harness 40 is inserted through the sling 30 and through a slot formed in the rim of the bucket 24, length 42 extending downward exteriorly of the sling 30 to insertion point B. At insertion point B the length 42 of the harness 40 is again inserted through the sling 30 and is threaded through a slot formed in the base of the bucket 24, length 42 continuing to run across the base interiorly of the sling 30 and bucket 24 to the other side. The ends of the harness 40 converge to the spring link connector 50. This resulting combination of the single-strap cradle-configuration harness 40 plus the manner by which the lengths 42 are interwoven into and out of the sling 30/bucket 24 ensures the greatest degree of suspension stability, protection for the occupants, a weight-bearing strength of approximately 180 lbs or more (the device is limited by the weight the parent can lift and lower in a controlled fashion), and resistance of the harness 40 to heat and flame.

Figure 4:
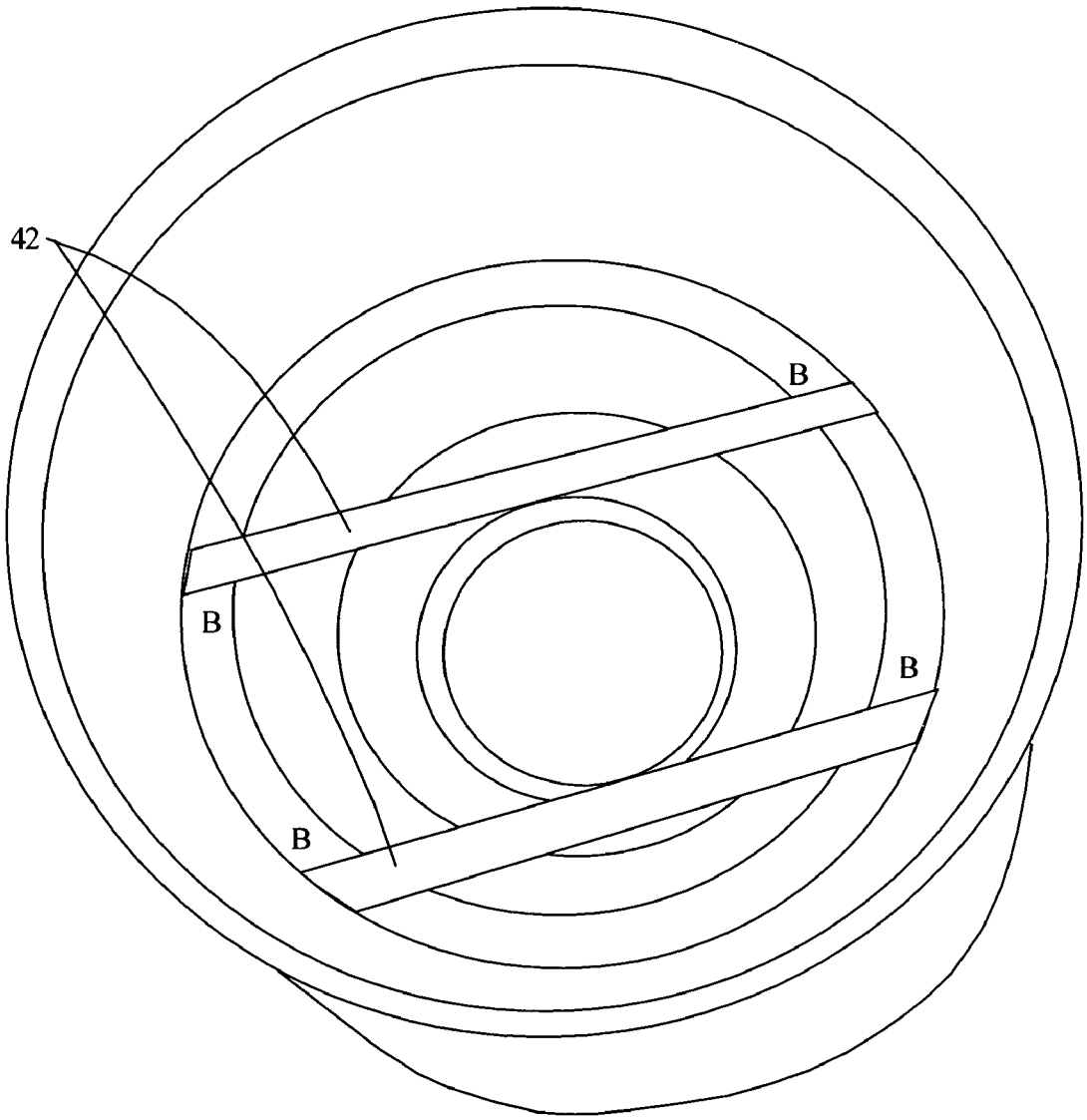
FIG. 4 is an overhead perspective view of the bucket 24 (sling 30 removed) showing the harness 40 penetrating insertion points B.

FIG. 4 is an overhead perspective view of the bucket 24 (sling 30 removed) showing the harness 40 penetrating insertion points B.

Figure 5:
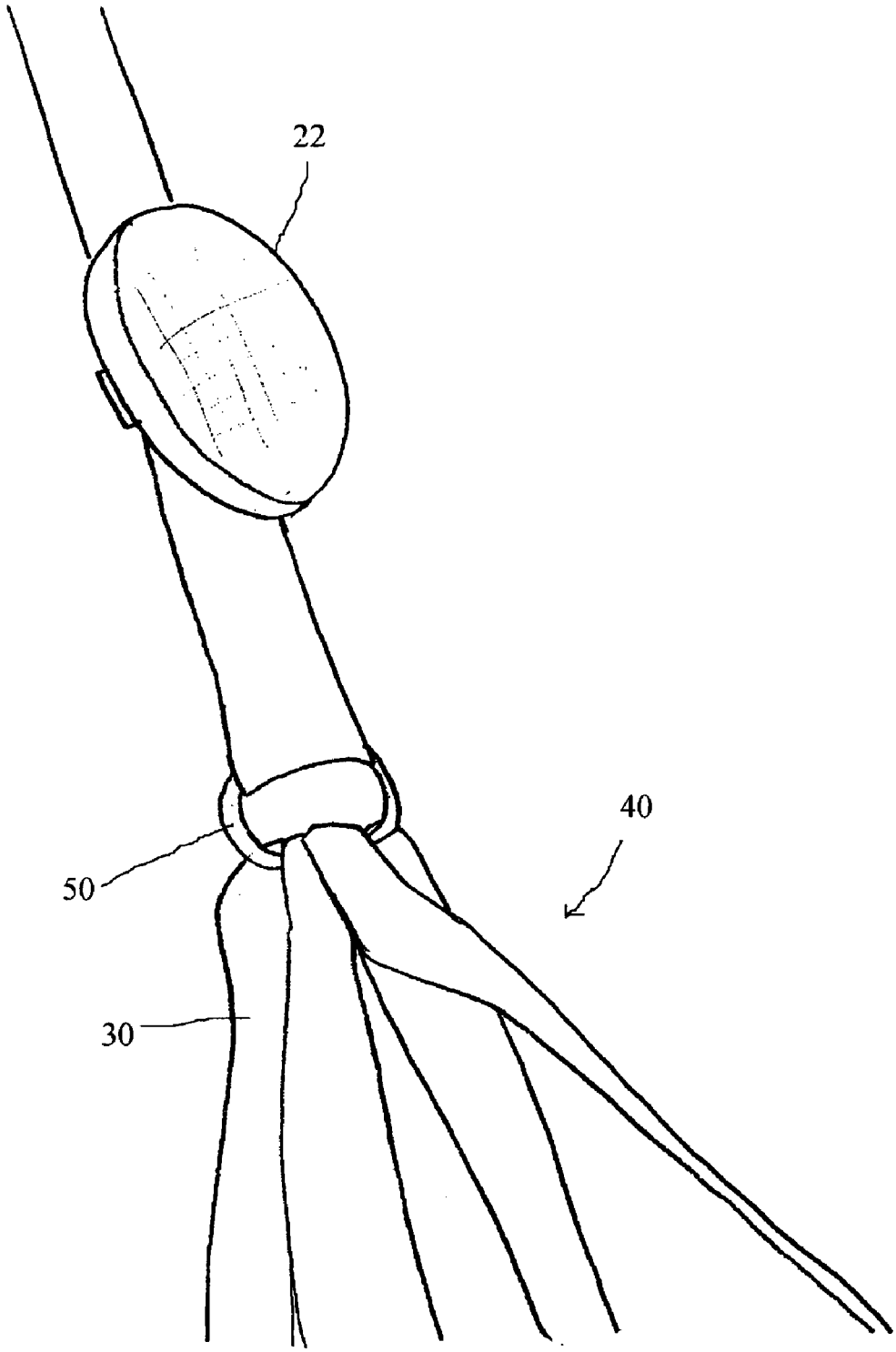
FIG. 5 is a close-up view of the harness 40 attached to spring link connector 50 and, additionally, the intermittent strobe 22 attached to harness 40 above the spring link connector 50.

FIG. 5 is a close-up view of the harness 40 attached to spring link connector 50 and, additionally, the intermittent strobe 22 attached to harness 40 above the spring link connector 50.

The ends of the strap of harness 40 may be attached to the lower end of spring link connector 50 by joining them together with a grommet (a hole is burnt through the nylon so it won't fray and the grommet is then installed). The spring link 50 is then attached. Spring link connector 50 is preferably a conventional spring-loaded clasp rated to support approximately 180 lbs.

The standard tether 10 provided with the fire escape vessel 20 is attached by spring link 50 to the harness 40. Tether 10 is preferably a long length of Nylon mountain climber's strap. Generally, variable-length tether 10 is provided with at least one reinforced metal grommet 40 at one end for attachment to spring link connector 50. The other end of tether 10 is equipped with a series of five (5) grommets that allow variable length attachment to descent control fixture 12. Specifically, another spring link 50 can be attached to other end of tether 10 at a predetermined grommet, which in turn, is attached to the descent control fixture 12. The tether 10 is approximately 10' long. The series of evenly spaced metal grommets 40 allows the user to pre-measure an appropriate length of tether 10 for suspension of vessel 20 approximately 5" from the ground. The tether 10 is then attached to the descent control fixture 12 by the appropriate grommet 40 such that inadvertent dropping of the vessel by the user will not result in ground impact. Rather, by virtue of the woven tether construction there is a degree of inherent elasticity that will cushion the impact before reaching the ground, thereby providing a failsafe descent control feature. A supplemental length of tether 10 may be provided as described below to adapt the system for use in three (3) story dwellings and buildings.

The intermittent strobe 22 is preferably an LED flashing safety light with quick release clip and powered by AAA batteries. A variety of suitable LED lamp units are readily available. The strobe 22 may be attached to the harness 40 below spring link connector 50 or to tether 10 above the coupling. The light emitting intermittent strobe 22 is readily visible in darkness and is intended to signal the attention of emergency personnel.

Figure 6:
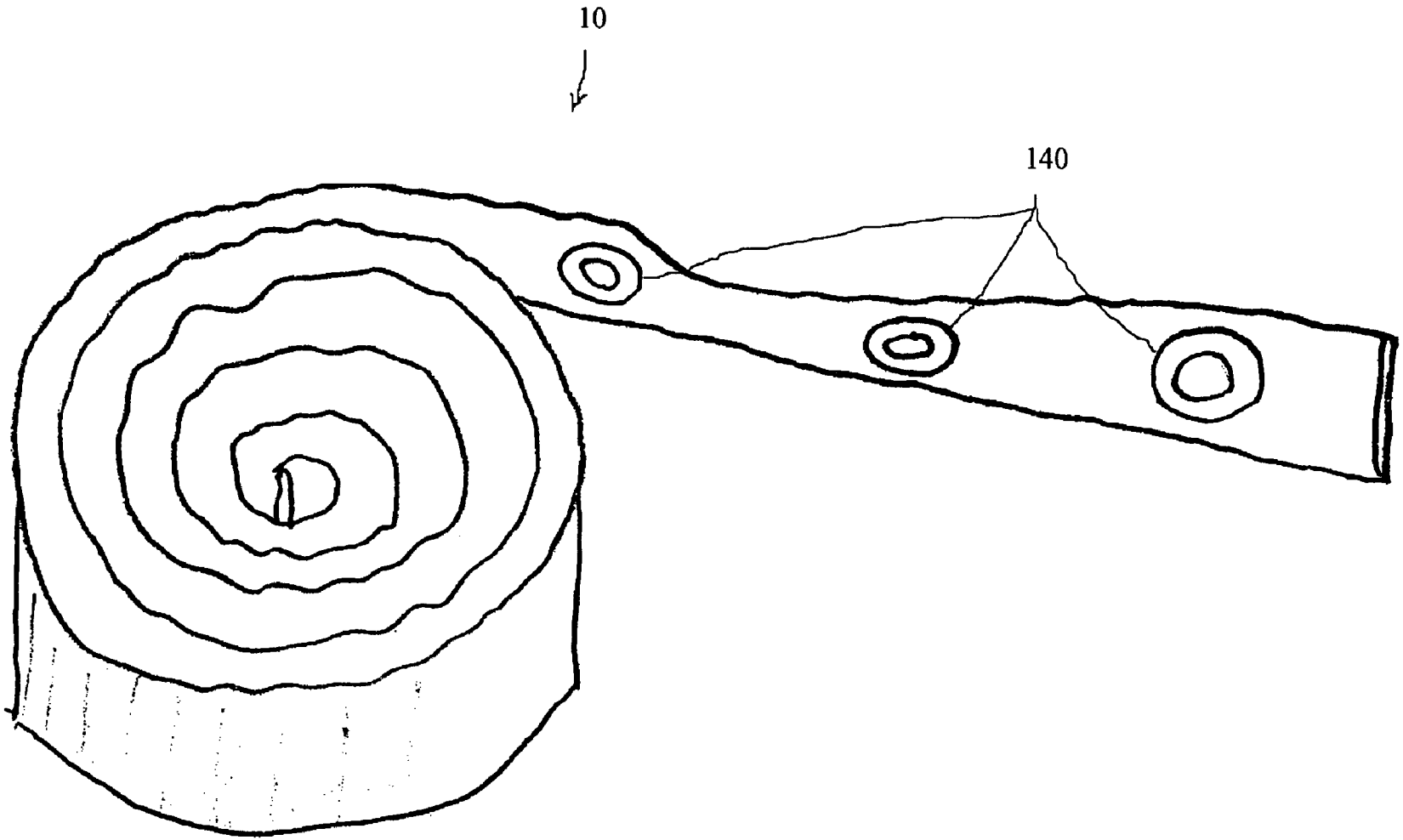
FIG. 6 is a close-up view of the variable-length tether 10.

FIG. 6 is a supplemental length of tether 10 that adapts the system for use in three (3) story dwellings. This supplemental tether 10 has a length of approximately 12' and is equipped with five (5) grommets 40 on both ends to extend the length of the above-described standard tether. As before, a numbered series of evenly spaced metal grommets 40 are provided along the end of the supplemental tether 10 to be attached to the descent control fixture 12 for selectable height adjustment for suspension of vessel 20 approximately 5" from the ground. The supplemental and standard tethers are attached together to extend their combined length. Again, inadvertent dropping of the vessel by the user will not result in ground impact.

Installation of the above-described tethered fire escape begins with the user attaching a plurality of descent control fixtures 12 throughout the dwelling at appropriate evacuation points. The user then pre-measures the extent of tether 10 necessary to avoid impact with the ground for each descent control fixture 12, notes the appropriately-numbered grommet 40 on tether 10 and marks the number next to each descent control fixture 12. The device is stowed for an emergency. In an emergency directions are provided with the fire escape that will direct the user to first establish an evacuation route and to lower a fire escape, ladder or other means for their own descent. Next, the user attaches the tether 10 at the selected evacuation point using the correct pre-numbered grommet 40. Children, pets and belongings are loaded into the vessel 20 and the top panel 124 of sling 30 is closed over them via the draw-string and closure cover and shield them from flames. The intermittent strobe 22 is activated, and the entire vessel 20 is then lowered to its suspended position above the ground where emergency personnel will see the strobe and rescue the occupants.

Figure 7:
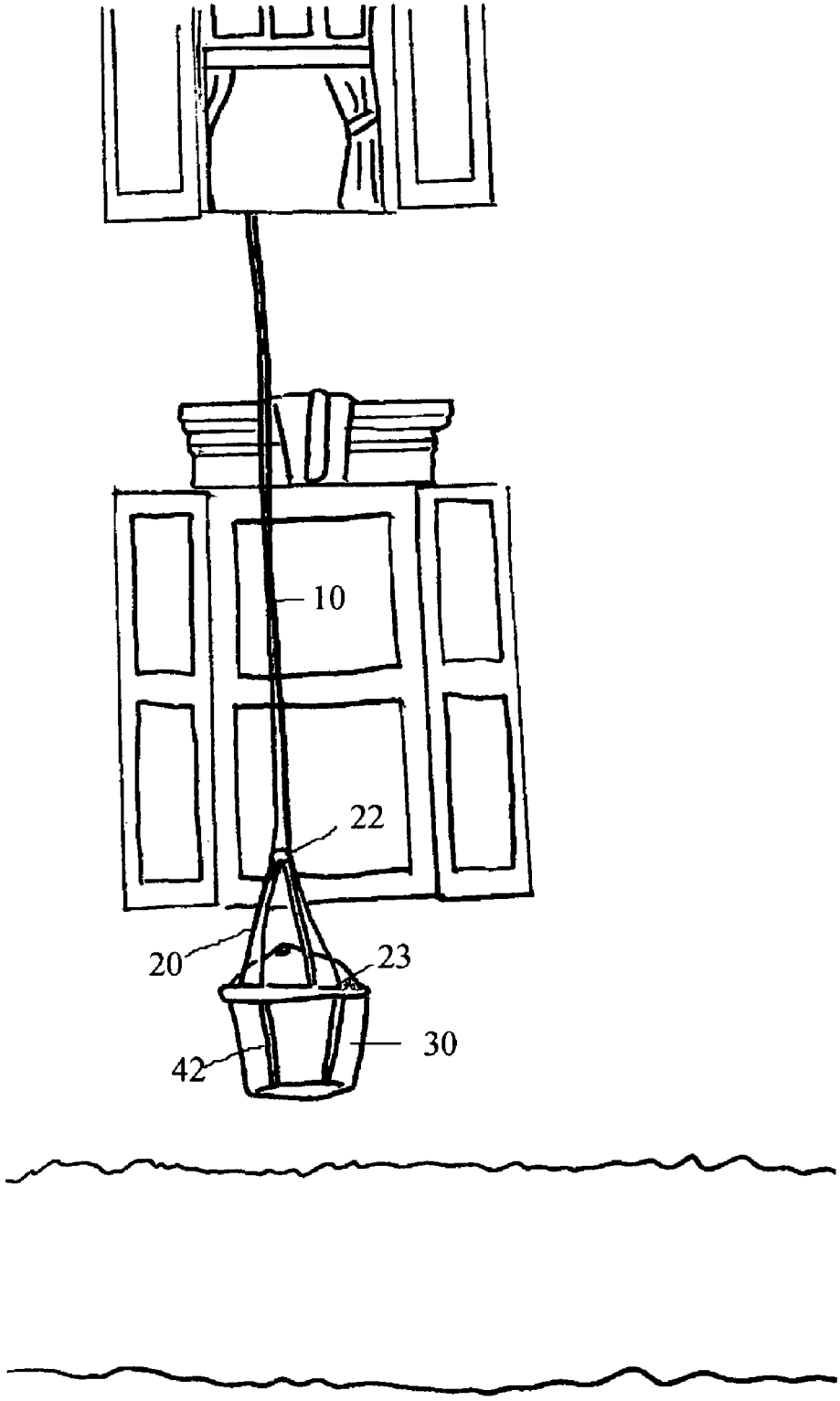
FIG. 7 is a perspective photo showing the tethered fire escape as described above.

FIG. 7 is a perspective photo showing the device in use as described above.

Once the payload is lowered to safety the unencumbered user/parent is then free to seek their own evacuation route by the fire escape, ladder or other means which they have already lowered. It can be seen that the above-described fire escape device excels at safely, securely and comfortably balancing and lowering multiple children, pets and other articles through a controlled-descent to the ground during fires or other emergencies. The escape vessel 20 and harness 40 offer maximum strength, security and protection against heat and flames, and the indexed grommets 44 of the variable tether 10 provide a failsafe descent feature to avoid impact with the ground if the parent loses control.

Having now fully set forth a detailed example and certain modifications incorporating the concept underlying the present invention, various other modifications will obviously occur to those skilled in the art upon becoming familiar with said underlying concept. It is to be understood, therefore, that within the scope of the appended claims, the invention may be practiced otherwise than as specifically set forth in the appended claims.

I claim:

1. A tethered fire escape for lowering a payload comprising children, pets and/or possessions to the ground, comprising:

a descent control fixture anchored to a building at a fire escape point;

a tether engaged at one end with said descent control fixture;

a hard-shell vessel;

a fire-resistant fabric sling around said vessel and having a flap-covered opening for loading said vessel and then completely enclosing the payload;

a load-carrying harness comprising a strap supporting said sling and vessel, said harness being attached to another end of said tether for lowering the payload in a manually-controlled descent to the ground.

2. The tethered fire escape according to claim 1, further comprising an intermittent strobe light attached to said variable tether to signal the attention of emergency personnel.

3. The tethered fire escape according to claim 1, wherein said descent control fixture is a cleat anchored inside and beneath a window sill or terrace rail.

4. The tethered fire escape according to claim 1, wherein said descent control fixture is a rope clutch anchored inside and beneath a window sill or terrace rail.

5. The tethered fire escape according to claim 1, further comprising a pair of spring clamps for attaching said tether to said descent control fixture and harness.

6. The tethered fire escape according to claim 1, wherein said vessel further comprises a plastic bucket of approximately 30 gallon size.

7. The tethered fire escape according to claim 6, wherein said plastic bucket includes opposing rim-mounted carrying handles.

8. The tethered fire escape according to claim 1, wherein said fire-resistant sling is sewn from a pattern using a fire-resistant fabric that is compliant with the Minimum Thermal Protective Performance Ratings established by the NFPA.

9. The tethered fire escape according to claim 8, wherein said fire-resistant sling includes a bottom panel sewn to a side panel, and a closure for selectively completely covering the vessel.

10. The tethered fire escape according to claim 9, wherein said closure comprises a draw-string.

11. The tethered fire escape according to claim 7, wherein said fire-resistant sling is sewn from a pattern to leave apertures therein to allow the handles of said bucket to protrude through.

12. The tethered fire escape according to claim 1, wherein said harness further comprises a single length of strap inserted through said vessel in a cradle configuration.

13. The tethered fire escape according to claim 12, wherein said cradle configuration harness further comprises two orthogonal loops penetrating both the sling and vessel at eight insertion points.

14. The tethered fire escape according to claim 13, wherein the ends of the harness converge above said vessel for maximum suspension stability and weight-bearing strength.

15. The tethered fire escape according to claim 5, wherein said tether is a variable-length tether having a series of evenly-spaced grommets at one end for attachment to a corresponding spring link connector.

16. The tethered fire escape according to claim 15, wherein said tether is approximately 10 feet long.

17. The tethered fire escape according to claim 16, further comprising a supplemental tether for attachment to said 10' tether to extend the total length of the combined tethers.

* * * * *